US005790155A

United States Patent [19]

Usui et al.

[11] Patent Number: 5,790,155

[45] Date of Patent: Aug. 4, 1998

[54] INK JET TYPE RECORDING HEAD HAVING HEAD UNITS WITH ANGLED WALLS AND ANGLED PRESSURE GENERATING CHAMBERS

[75] Inventors: Minoru Usui; Takahiro Katakura; Munehide Kanaya, all of Nagano, Japan

[73] Assignee: Seiko Epson Corporation, Tokyo, Japan

[21] Appl. No.: 747,044

[22] Filed: Nov. 12, 1996

[30] Foreign Application Priority Data

Nov. 10, 1995 [JP] Japan ..... 7-317224
Sep. 27, 1996 [JP] Japan ..... 8-277095

[51] Int. Cl.[6] ..... B41J 2/045

[52] U.S. Cl. ..... 347/68

[58] Field of Search ..... 399/20, 40, 47, 399/68, 70, 55, 128

[56] References Cited

U.S. PATENT DOCUMENTS

| | | | |
|---|---|---|---|
| 4,835,554 | 5/1989 | Hoisington et al. | 347/40 X |
| 4,891,654 | 1/1990 | Hoisington et al. | 347/40 |
| 5,157,420 | 10/1992 | Naka et al. | 347/40 |
| 5,353,050 | 10/1994 | Kagayama | 347/55 |

FOREIGN PATENT DOCUMENTS

| | | | |
|---|---|---|---|
| 0 512 799 | 11/1992 | European Pat. Off. . | |
| 0 666 174 | 8/1995 | European Pat. Off. . | |
| 62-77951 | 4/1987 | Japan | 347/40 |
| 63-9557 | 1/1988 | Japan | 347/128 |
| 3-82565 | 4/1991 | Japan | 347/128 |

OTHER PUBLICATIONS

Patent Abstracts of Japan vol. 013, No. 365 (M-859), Aug. 15, 1989, & JP 01 122441 A (Fuji Electic Co Ltd), May 15, 1989 *Abstract.

*Primary Examiner*—S. Lee
*Attorney, Agent, or Firm*—Sughrue, Mion, Zinn, Macpeak & Seas, PLLC

[57] ABSTRACT

An ink jet type recording head composed of a plurality of head units and having a large number of nozzles without greatly increasing the width of the recording head. Outer walls 1*a*, 1*b* of a spacer 1 of the heat unit are inclined at an angle θ with respect to the arrangement lines A—A, B—B of pressure generating chambers 2, 3. A plurality of head units (e.g., 40, 41) are arranged so that end surfaces of the head units in the arrangement direction of the pressure generating chambers 2, 3 are adjacent to each other. The head units are fixed to a base board 28 such that they are shifted in a direction roughly perpendicular to the arrangement direction of then pressure generating chambers 2, 3 and so that an interval between the pressure generating chambers 2, 3 of the adjacent head units is the same as the pitch between the pressure generating chambers 2, 3 on each individual head unit. Accordingly, it is possible to arrange the nozzle openings of the plurality of head units at a uniform pitch even over several head units and nonetheless maintain the width of the entire recording head as narrow as possible.

10 Claims, 13 Drawing Sheets

INK JET TYPE RECORDING HEAD HAVING HEAD UNITS WITH ANGLED WALLS AND ANGLED PRESSURE GENERATING CHAMBERS

BACKGROUND OF THE INVENTION

1. Field of the Invention

The present invention relates to an ink jet type recording head in which a piezoelectric vibrator or other pressure generating means is provided in a region of a pressure generating chamber communicating with a nozzle opening. Ink drops are generated when the pressure generating chamber is compressed by the deflection vibration of the piezoelectric vibrator.

2. Description of the Related Art

In order to conduct printing at high speed and high density, it would be desirable to increase the number of nozzle openings per recording head. In an ink jet type recording head, since liquid such as ink is treated in the nozzle openings, the pressure generating chamber, etc., it is necessary to manufacture the nozzle openings and ink passages of the recording head with high accuracy and with great uniformly. In an ink jet type recording, a liquid ink drop is projected toward and deposited on a recording medium. The amount of dispersion of the ink droplet is easily influenced by variations in the accuracy of the pressure generating chamber. Furthermore, a curvature in the trajectory of the ink droplet may result from inaccuracies in the nozzle openings.

When even one of the nozzle openings or passages is out of alignment, the printing quality of the recording head markedly deteriorates, and the recording head becomes useless. Therefore, the manufacturing yield for ink jet type recording heads is much lower than the yield for wire-impact type recording heads or thermal transfer type recording heads.

SUMMARY OF THE INVENTION

Objects of the Invention

In order to solve the above problems, it is possible to construct a recording head as follows. The recording head itself is made in such a manner that the number of nozzle openings is relatively small. The thus formed recording head is then used as a unit together with additional units, and the plurality of units are formed into one body and fixed onto a base board piece, to produce one recording head. However, the following problems may be encountered in the above recording head. The width of the side walls of adjacent units is larger than the pitch of the arrangement of nozzle openings. Accordingly, it is necessary to arrange the units in a zigzag pattern by shifting every other unit laterally by a distance corresponding to the width of one unit. As a result, the width of the recording head becomes, at a minimum, twice as great as that of an individual unit.

The present invention has been accomplished in view of the above problems. It is an object of the present invention to provide an ink jet recording head composed of a plurality of individual units in which the number of nozzles per recording head can be increased without significantly increasing the width of the recording head overall.

Summary of the Invention

In order to solve the above problems, the present invention provides an ink jet type recording head comprising a plurality of head units, each head unit including a plurality of pressure generating chambers for pressurizing ink by a pressure generating means, wherein the pressure generating chambers are arranged in line in an arrangement direction, and each chamber is inclined AT an angle θ with respect to the arrangement direction. Outer edges of the head units in the arrangement direction are also lo inclined by an angle θ with respect to the arrangement direction of the pressure generating chambers. The head units are arranged in a pattern such that each unit is shifted along the inclination of an adjacent unit away from a midline position of the adjacent unit. The arrangement of units is then fixed onto a base board so that the pitch between the pressure generating chambers opposing the outer edges in the arrangement direction of the pressure chambers is the same as that between the pressure generating chambers on the individual head units themselves.

In the above arrangement, opposing outer walls of adjacent head units are also inclined with respect to a straight line perpendicular to the arrangement direction of the pressure generating chambers. Accordingly, when the head units are shifted along the incline of the outer walls, a distance between adjacent head units in the arrangement direction of the pressure generating chambers is changed. Accordingly, an interval between the pressure generating chambers of respective adjacent units can be changed in the arrangement direction of the pressure generating chambers in accordance with the amount of shift between the adjacent units. Due to the foregoing, the head units need not be staggered in a full zigzag pattern, and the width of the recording head can be reduced. Therefore, the increase in the width of the recording head is minimal in light of the large number of head units arranged on the recording head.

DETAILED DESCRIPTION OF THE PREFERRED EMBODIMENTS

Referring to various embodiments illustrated in the accompanying drawings, the present invention will now be explained in detail.

Figure 1:
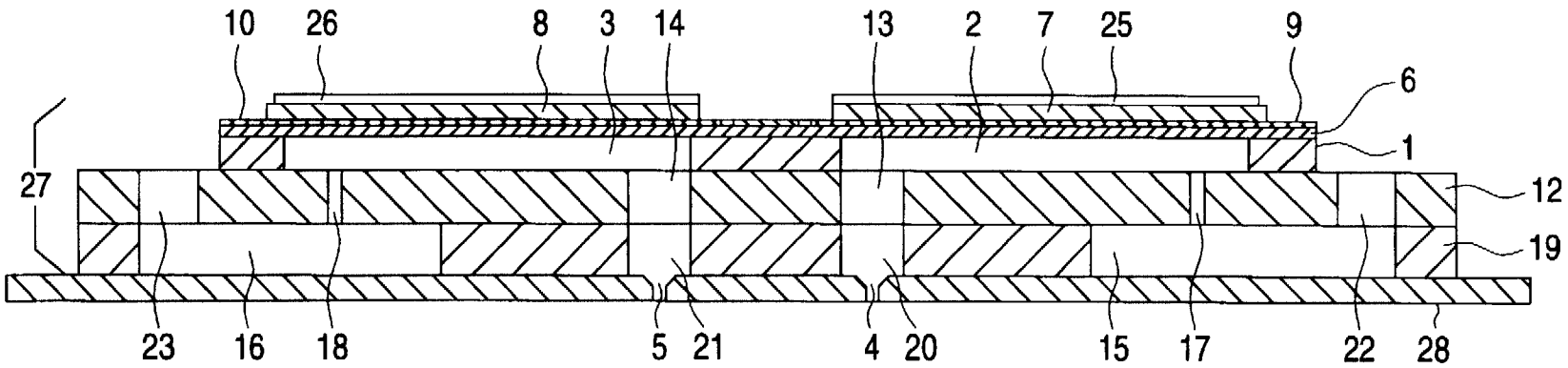
FIG. 1 is a cross-sectional view of a first embodiment of an ink jet type recording head according to the present invention, wherein the view shows a portion close to a pressure generating chamber.
Figure 2:
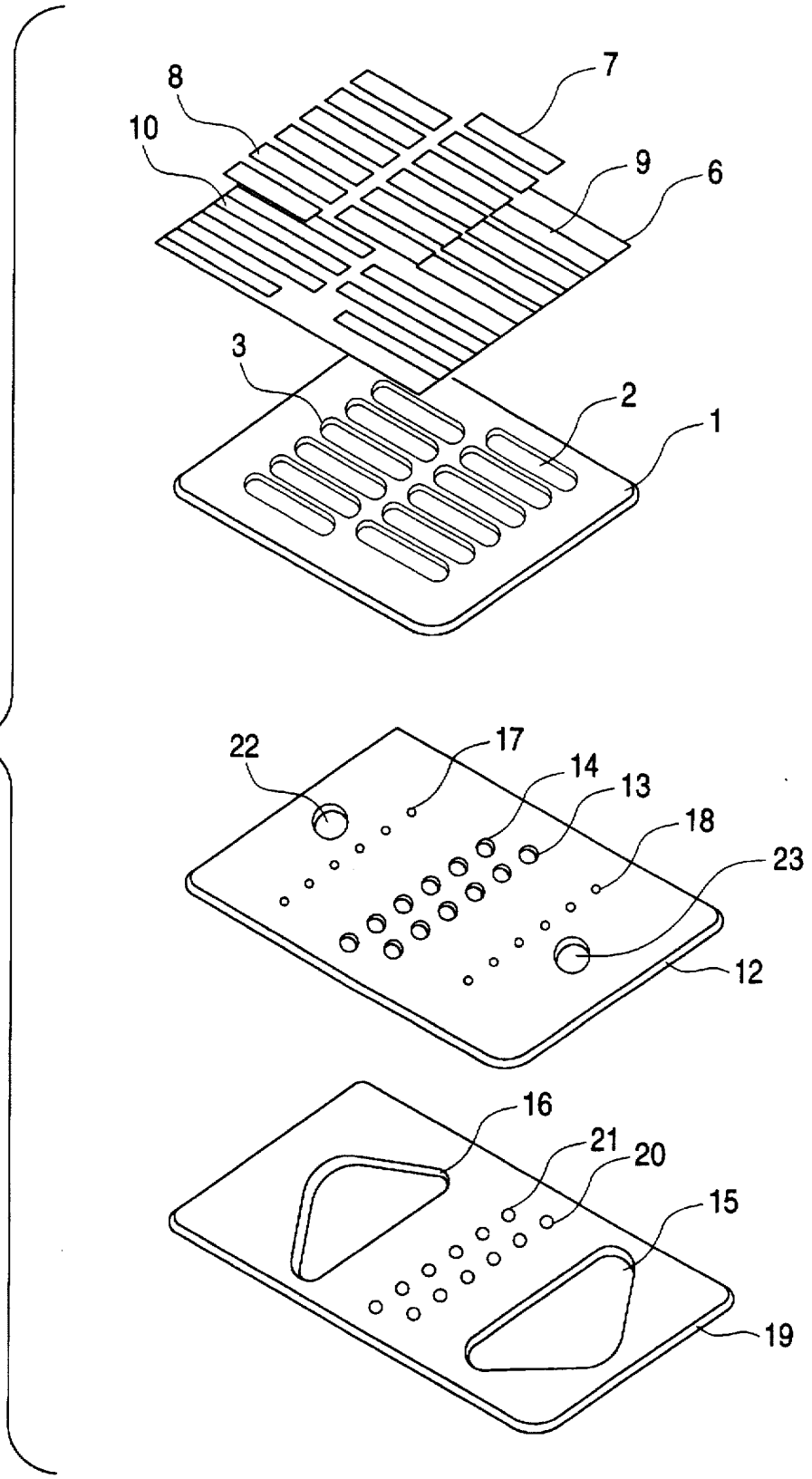
FIG. 2 is a perspective view showing an assembly process for the head unit shown in FIG. 1.
Figure 3:
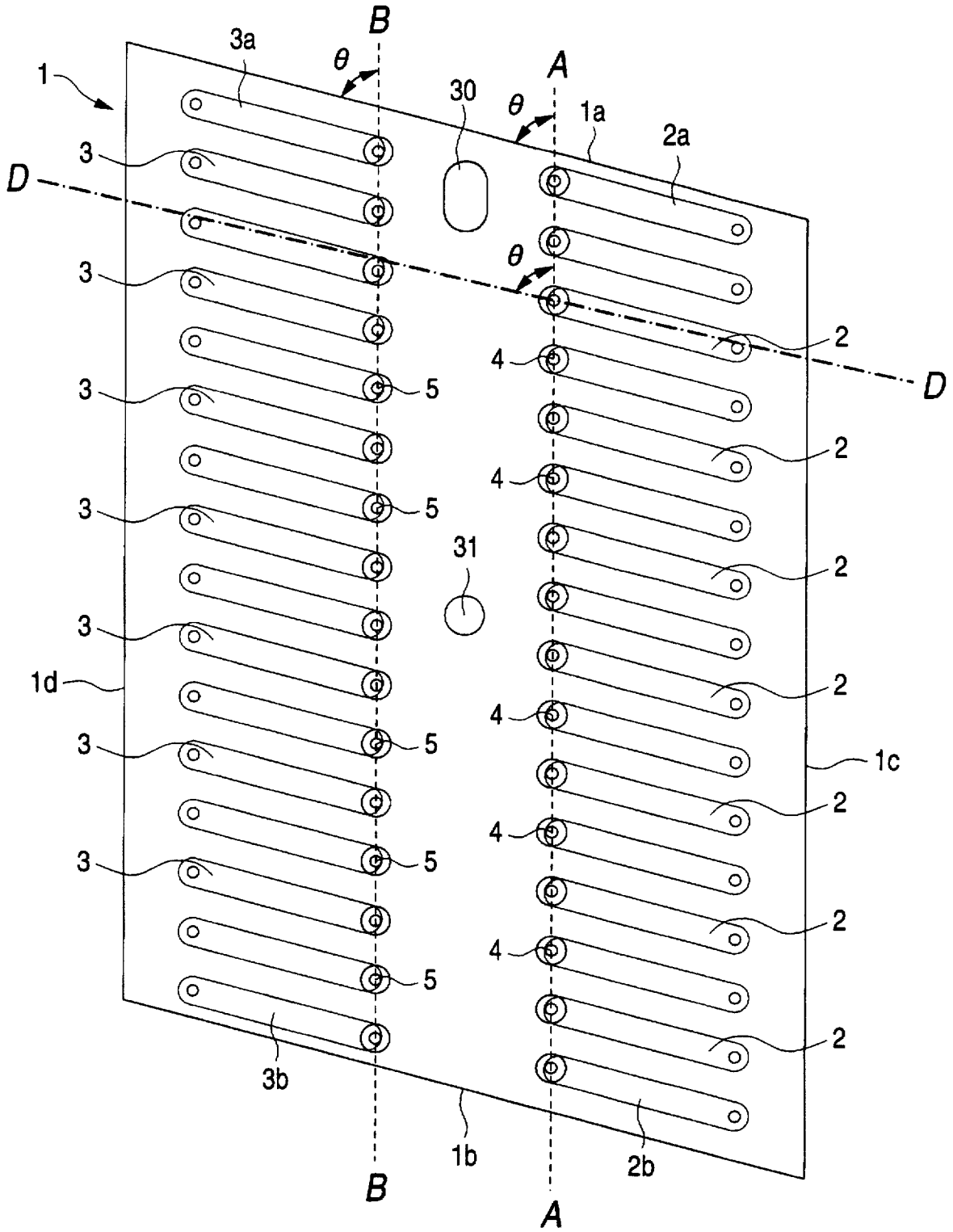
FIG. 3 is a front view of an example of a spacer used in the head unit.
Figure 4:
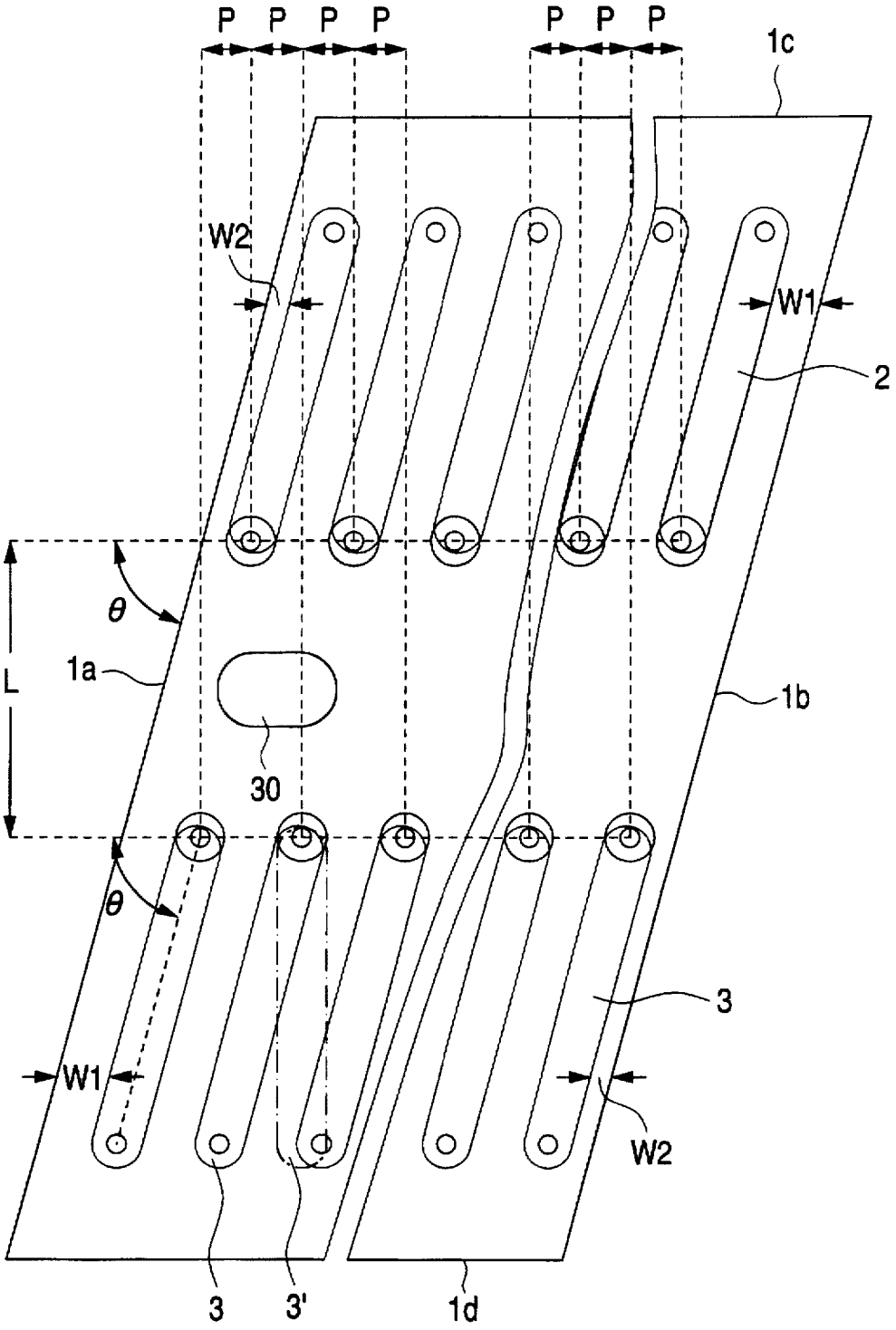
FIG. 4 is an enlarged front view of an end portion of the spacer.

FIG. 1 illustrates a first embodiment of a recording head according to the present invention. FIG. 2 is a view showing an example of one head unit provided in the recording head. In the drawing, reference numeral 1 designates a spacer, which is composed of a base board made of ceramics such as zirconia ($ZrO_2$). The thickness of the spacer 1 should be appropriate for forming pressure generating chambers 2, 3, the depth of which is preferably approximately 150 μm. As shown in FIGS. 3 and 4, the pressure generating chambers 2, 3 provided in the base board 1 are arranged in such a manner that a longitudinal axial line of each pressure generating chamber forms an acute angle θ with respect to the arrangement direction of the nozzle openings 4, 5. The acute angle θ is preferably set to be greater than 45 degrees and less than 90 degrees (i.e. $45°<\theta<90°$). An illustrative longitudinal axial line is shown in FIG. 3 at D—D, while the arrangement direction is illustrated by arrangement lines A—A and B—B.

Outer walls 1*a*, 1*b*, forming an outer periphery of the spacer 1 near the pressure generating chambers 2*a*, 2*b*, 3*a*, 3*b*, are approximately parallel to the axial lines of the pressure generating chambers 2, 3. Also, the remaining outer walls 1*c*, 1*d*, which are located on the right and left in FIG. 3, are approximately parallel to the arrangement lines A—A and B—B of the nozzle openings. The outer walls 1*a*, 1*b* are constructed so that the end widths W1, W2 are reduced as much as possible.

When the pressure generating chambers 2, 3 are arranged to be inclined so that the axial direction of the pressure generating chambers 2, 3 forms an acute angle θ with respect to the nozzle opening arrangement lines A—A and B—B, the lengths of the pressure generating chambers 2, 3 can be increased so that they are longer than comparable, conventional pressure generating chambers that are arranged perpendicularly to the nozzle opening arrangement lines A—A and B—B. Due to the foregoing, even when the width of the recording head must be reduced, e.g., to increase recording head density, it is nonetheless possible to ensure that each pressure generating chamber has a sufficiently large ink capacity.

Referring again to FIGS. 1 and 2, reference numeral 6 designates a diaphragm, which is composed of a sheet of zirconia and has a thickness of, e.g., 10 μm. Therefore, when the diaphragm 6 is baked integrally with the spacer 1, a sufficiently high joining force can be achieved. Since the diaphragm is composed of a sheet of zirconia, just like the spacer 1 is, it can be elastically deformed when piezoelectric vibrators 7, 8 are actuated.

Reference numerals 7, 8, designate the piezoelectric vibrators mentioned above. The piezoelectric vibrators 7, 8 are made by sintering a green sheet of piezoelectric material onto a surface of drive electrodes 9, 10 formed on a surface of the diaphragm 6.

In FIGS. 1–2, a cover sheet, indicated at 12, is integrally adhered onto the other surface of the spacer 1. In this example, the cover sheet 12 is made of a sheet of zirconia, the thickness of which is, e.g., 150 μm. On the cover sheet 12, through-holes 13, 14 connect the nozzle openings 4, 5 of the nozzle plate 28 with the pressure generating chambers 2, 3. In addition, through-holes 17, 18 connect reservoirs 15, 16 with the pressure generating chambers 2, 3.

Reference numeral 19 indicates an ink feed passage composing sheet, which is made of a sheet member, such as a stainless steel sheet having the anticorrosion property, and which has a thickness of 150 μm or so. On the ink feed passage composing sheet 19, there are formed both through-holes which function as reservoirs 15, 16, and through-holes 20, 21 to connect the pressure generating chambers 2, 3 with the nozzle openings 4, 5.

The reservoirs 15, 16 are respectively connected with ink feed ports 22, 23 formed on the cover sheet 12. Therefore, the reservoirs 15, 16 receive ink from an ink tank arranged outside the recording head and feed it to the pressure generating chambers 2, 3 via the through-holes 17, 18.

As described above, the recording head includes members 1, 6, 12 and 19. Of these members, the members 1, 6 and 12 are made of ceramics and are integrated into one body by means of baking. The member 19 is made of metal and is joined to the ceramic elements by an appropriate conventional method. In this way, these members are incorporated into a head unit 27.

Figure 5:
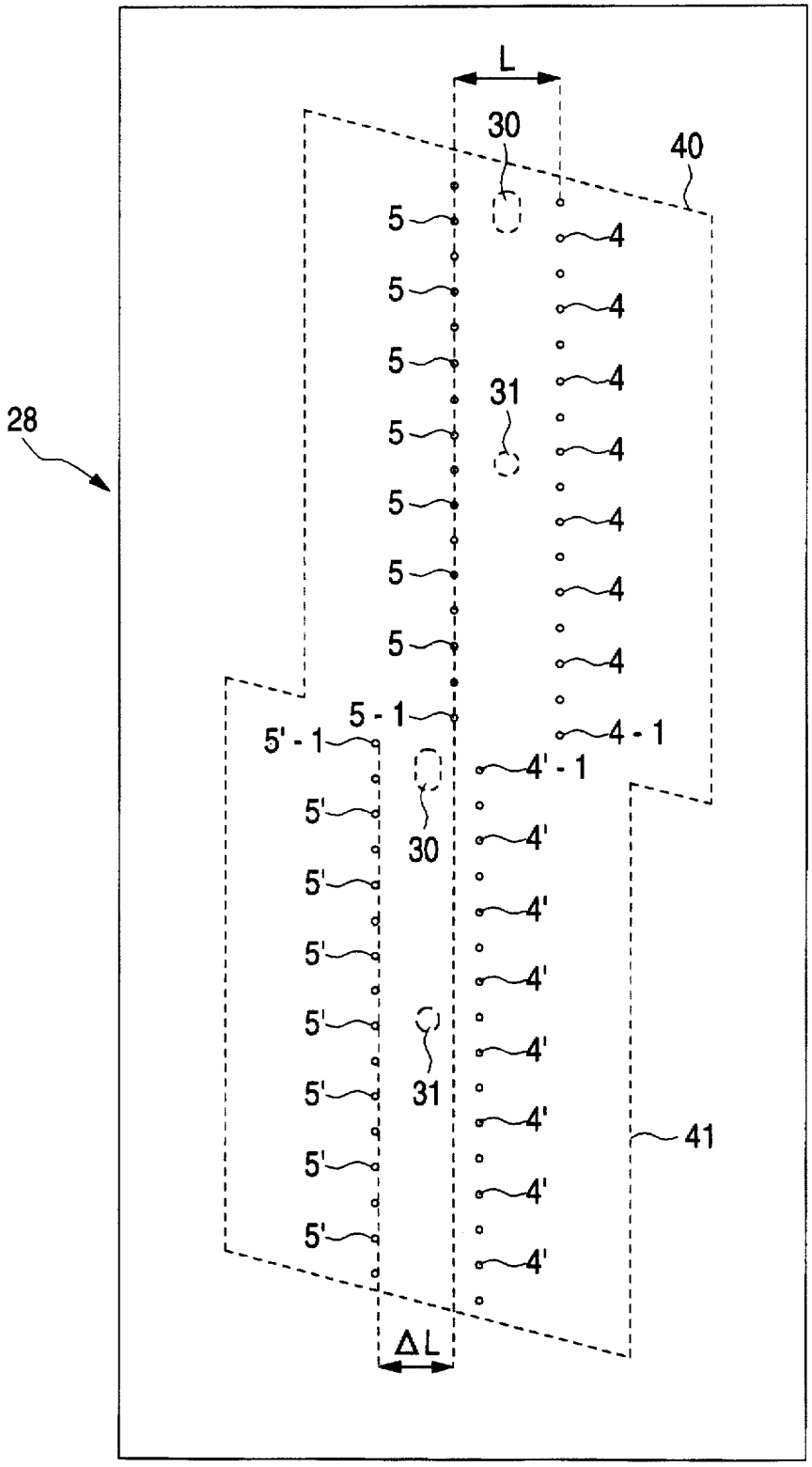
FIG. 5 is a front view of an example of a nozzle plate used as a base board, on which the head units are mounted.

As illustrated, e.g., in FIGS. 3–5, holes 30, 31, used for positioning, are provided substantially on a center line between the pressure generating chambers 2, 3. Due to the presence of the positioning holes 30, 31, even if the entire head unit contracts in the process of baking, the head unit can be correctly positioned at a reference position.

Figure 7:
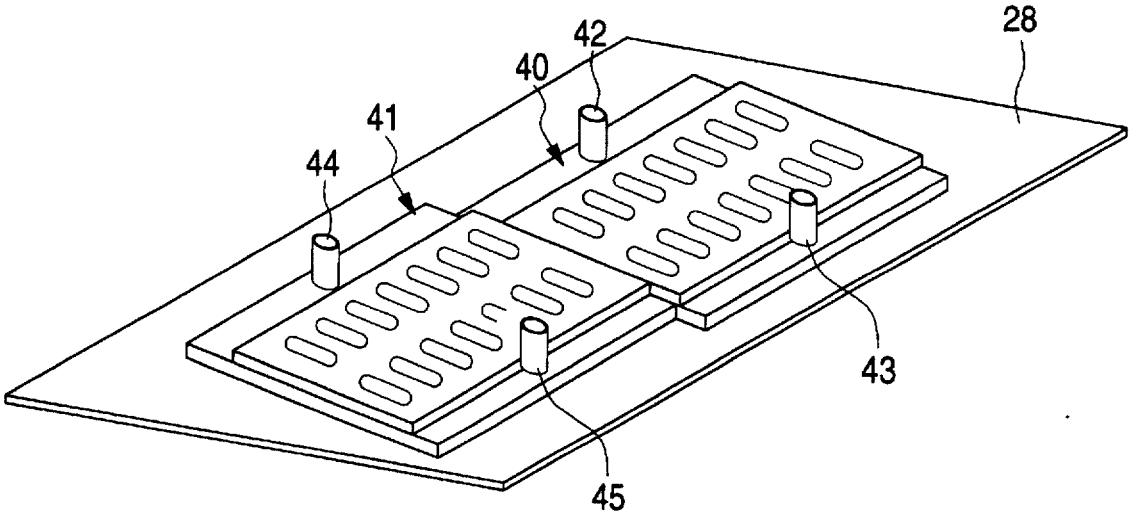
FIG. 7 is a perspective view showing an ink jet type recording head according to the present invention.

FIGS. 1, 5 and 7 show a nozzle plate at reference numeral 28. In the present embodiment, the nozzle plate 28 also functions as a fixing base board of the head unit. On the nozzle plate 28, two sets of nozzle openings 4, 5 and 4', 5' are provided. An interval between the nozzle openings 4 and 5 is set to a constant value L; likewise, an interval between the nozzle openings 4' and 5' is set to a constant value L. Finally, the nozzle openings 4' are shifted over from the nozzle openings 4 by a distance ΔL in the scanning direction, and the nozzle openings 5' are shifted from the nozzle openings 5 by the same distance ΔL in the scanning direction.

In this case, the shift distance ΔL is determined so that the head units 40, 41 do not overlap each other when they are fixed as shown in FIG. 5. Also, the shift distance ΔL is set so that the pitch of the nozzle openings in the paper feed direction is a constant value P0 even in a region where the units 40 and 41 oppose each other. In other words, the shift distance ΔL is determined so that the pitch of nozzle openings 4-1, 5-1 in particular, relative to the nozzle openings 4'-1, 5'-1, is the same as the pitch of the nozzle openings in other regions. More specifically, the shift amount ΔL is preferably no more than 80% of the distance from the outer wall 1*c* to the outer wall 1*d*.

Figure 6:
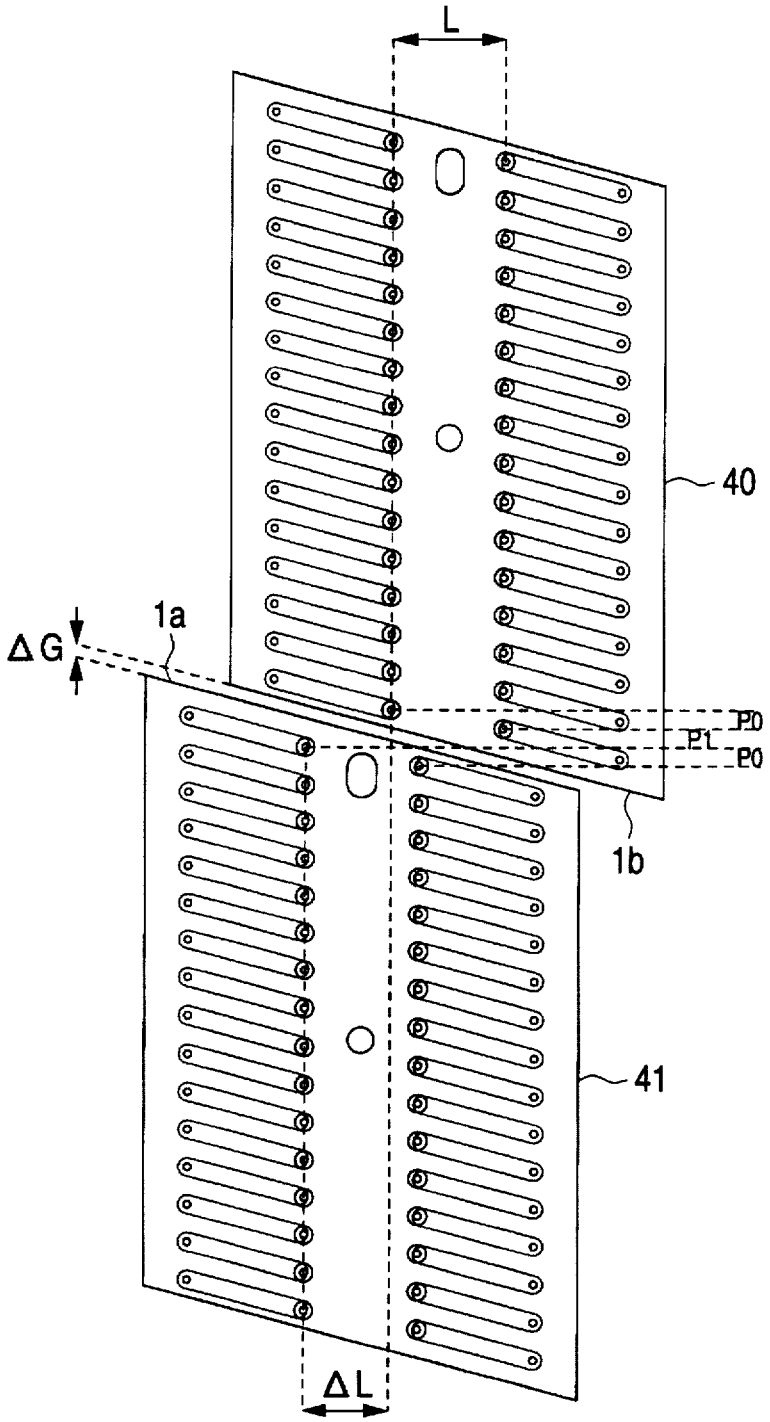
FIG. 6 is a front view showing a positional relation between two head units which have been arranged adjacent each other so as to provide a recording head.

In the head unit constructed as described above, as shown in FIGS. 6 and 7, the first head unit 40 and the second head unit 41 are shifted relative to each other by a lateral distance ΔL so that an interval P1 between the lowermost nozzle opening of the first head unit 40 and the uppermost nozzle opening of the second head unit 41 is the same as the pitch P0 for the sets of nozzle openings 4, 5 and 4', 5'. When necessary, a gap ΔG can be provided in the boundary, to produce the desired identity in pitch P1 and P0. The first and the second head unit are then fixed onto the nozzle plate 28.

In this case, the lower outer wall 1*b* of the first head unit 40 and the upper outer wall 1*a* of the second head unit 41 are respectively inclined by an angle θ with respect to the arrangement lines A—A and B—B. Also, the first and the second head unit are disposed slightly offset but still adjacent to each other in the upward and downward direction. Accordingly, it is possible to make the pitch P1 in the boundary coincide with the pitch P0 in the scanning direction by a shift distance ΔL which is shorter than the width of an entire unit (40, 41).

Reference numerals 42 to 45 in FIG. 7 designate ink feed pipes to feed ink from the ink tank to the reservoirs 15, 16. When printing signals are sent to the first head unit 40 and the second head unit 41, they are sent in timed relation so that the signal for the latter unit is shifted by a period of time corresponding to the number of dots which corresponds to the interval ΔL. When this is done, the recording head constructed as described above can conduct printing in the same manner as can a recording head in which nozzle openings are formed along the same straight line.

Figure 8:
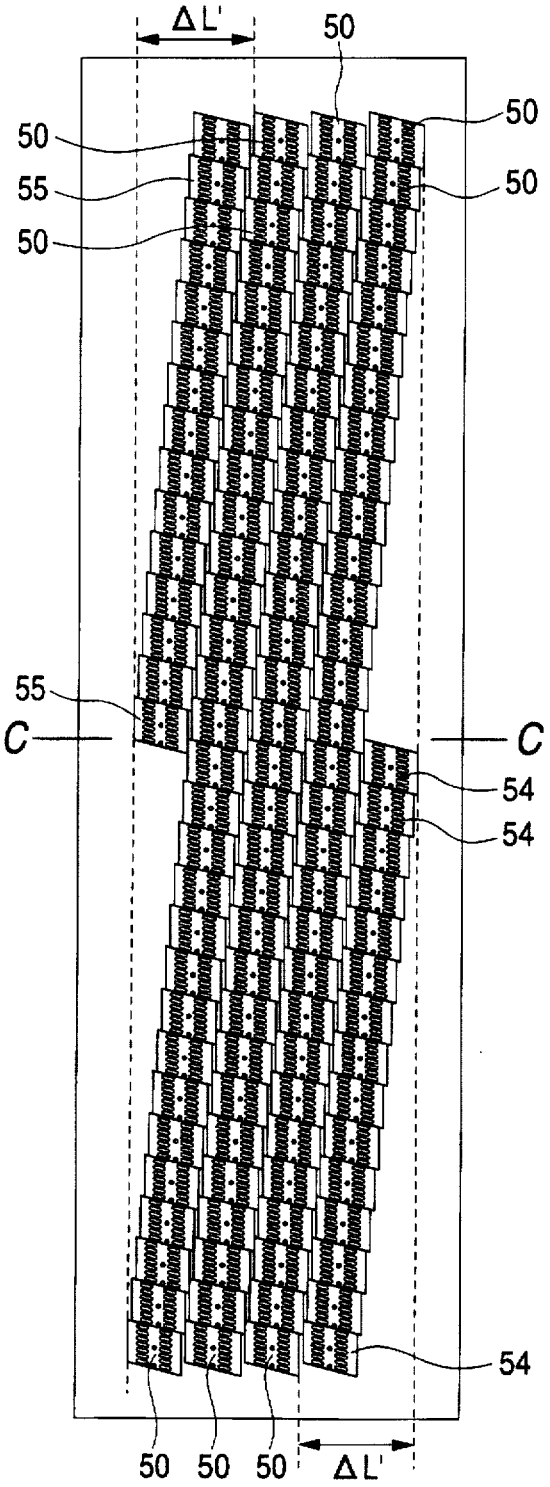
FIG. 8(*a*) is a view showing another example of the head unit arrangement according to the present invention, and FIG. 8(*b*) is a view showing another example of the nozzle opening arrangement according to the present invention.
Figure 8:
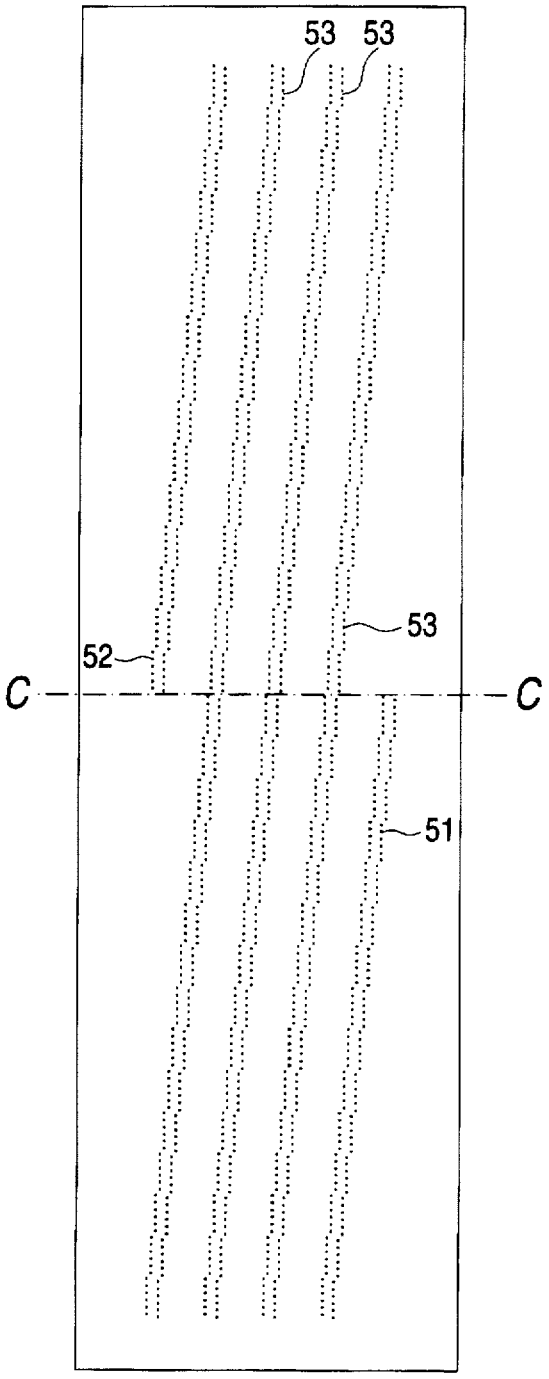

In the above example, the recording head is composed of two head units. However, three or more head units 50, 50, constructed as those described above, may be arranged in a column, as shown in FIG. 8. Alternatively, a plurality of columns may be arranged.

As shown in FIG. 8, when a large number of head units are arranged, in one column of width ΔL', e.g., when 30 head units are arranged with a shift ΔL (as shown in FIG. 5) formed between the head units forming the respective columns, a shift ΔL' results between an upper end and a lower end of the column of head units. Due to the foregoing, a triangular dead space is formed.

In this example, on both sides of the center line C with respect to the upward and downward direction, the head units 54, 55 are arranged in the same manner as described above. That is, one head unit extends downward with respect to the center line C, and the other head unit extends upward with respect to the center line C. The nozzle openings 51, 52 are located on a line of the nozzle openings 53 formed by the head unit 50 in the moving direction of the recording head.

Due to the foregoing construction, it is possible to conduct color printing in a wide region as follows even when the carriage conducts only one scanning operation. Inks of different colors, such as cyan, magenta and yellow inks, are respectively jetted out from two lines of nozzles which are continuously formed substantially linearly. Also, black ink is jetted out from two lines of nozzle openings which are divided to the right and left.

Due to the foregoing construction, as shown in FIG. 8(*b*), it is possible to arrange a large number of head units in line without changing the number of lines of nozzle openings. Also, the dead space is effectively utilized and the width of the recording head is not increased. In this connection, even in the recording head in which one line of nozzle openings is divided into two in the width direction, when the printing time is adjusted, it is possible to form dots in accordance with the printing position of the continuously formed nozzle opening line.

In the above example, the recording head is constructed as follows. One surface of the actuator unit 1, that is, a surface opposite to the surface onto which the diaphragm 6 is fixed, is open, and this surface is sealed by a flow passage forming plate 12. When the actuator unit 1 and the flow passage unit 12 are joined into one body in this way and arranged on the nozzle forming base board 28 in a predetermined manner, the recording head is completed.

Figure 9:
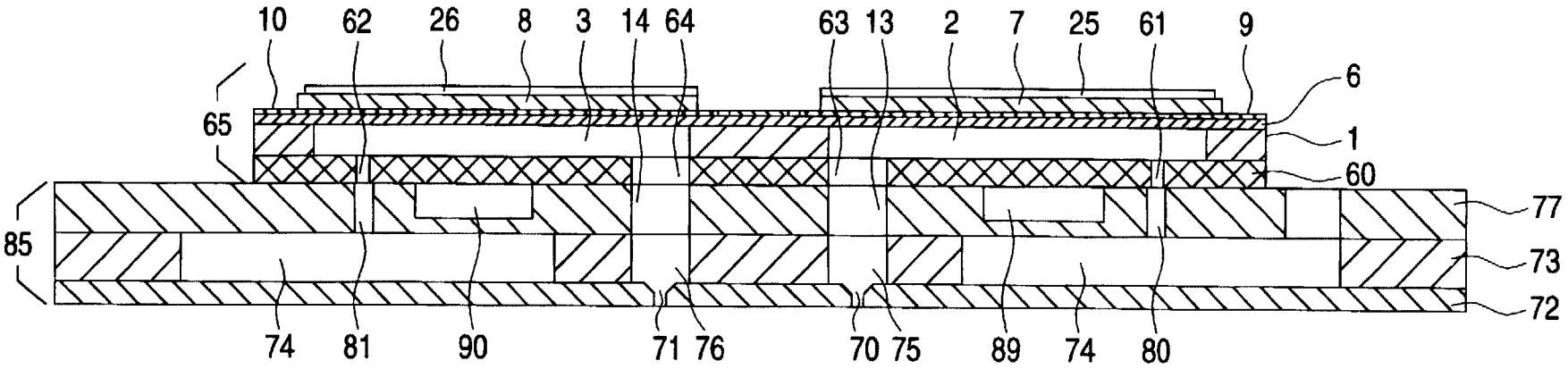
FIG. 9 is a cross-sectional view of another embodiment of the recording head according to the invention, wherein the view shows a portion close to the pressure generating chamber.
Figure 10:
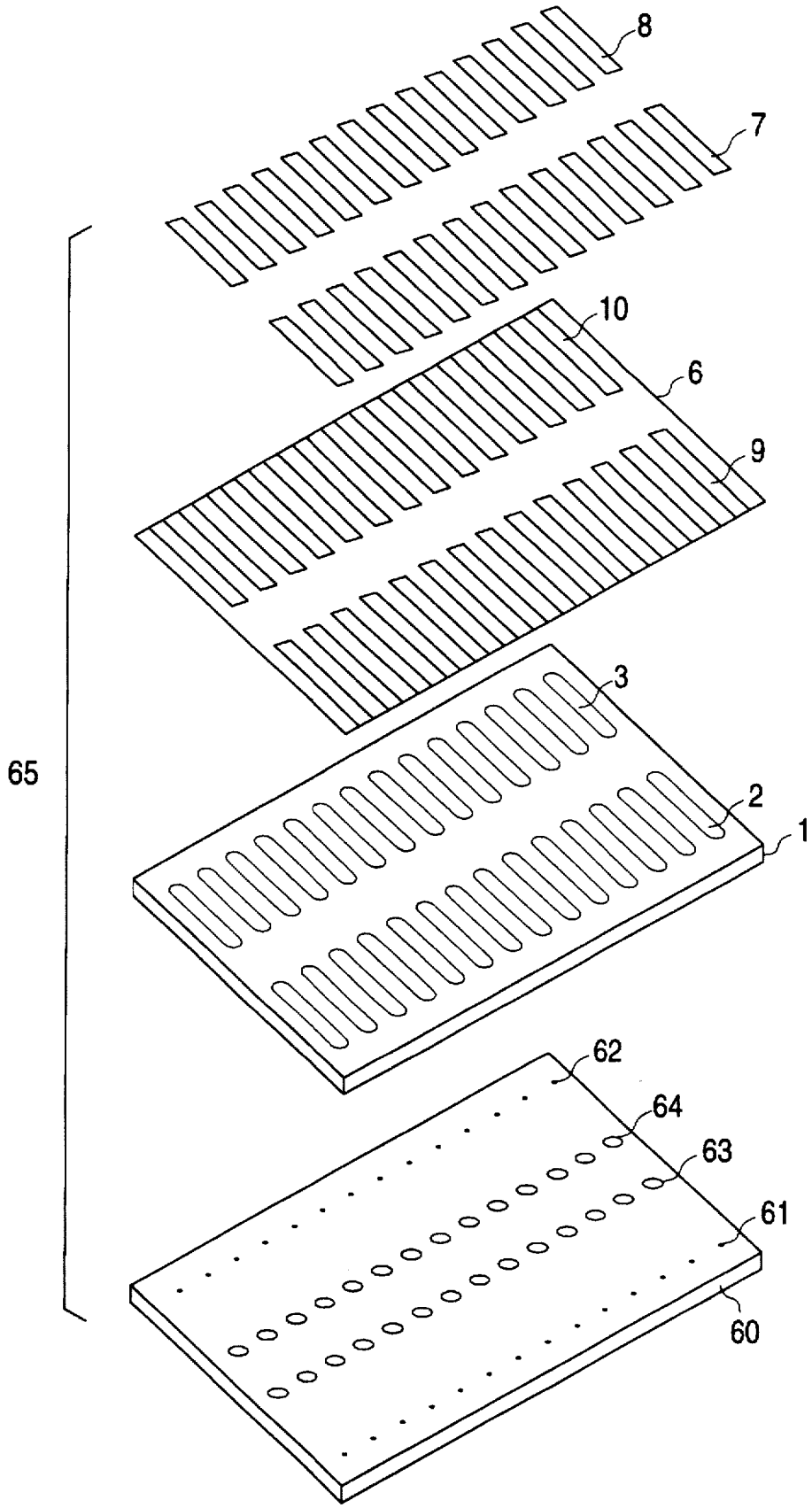
FIG. 10 is a perspective view showing an assembly process for an actuator according to the present invention, suitable for the recording head of FIG. 9.

However, it is also possible to construct a recording head as follows. As shown in FIGS. 9 and 10, one surface of the spacer 1 is sealed with the diaphragm 6 having piezoelectric vibrators 7, 8. The other surface of the spacer 1 is sealed with the cover member 60 having ink feed ports 61, 62 and nozzle communicating holes 63, 64, to thereby construct the actuator unit 65. This actuator unit 65 is fixed in the common flow passage unit 85, which also functions as a fixing base board. According to the above construction, it is possible to provide the same effect and benefits achieved by the previous embodiment.

Figure 11:
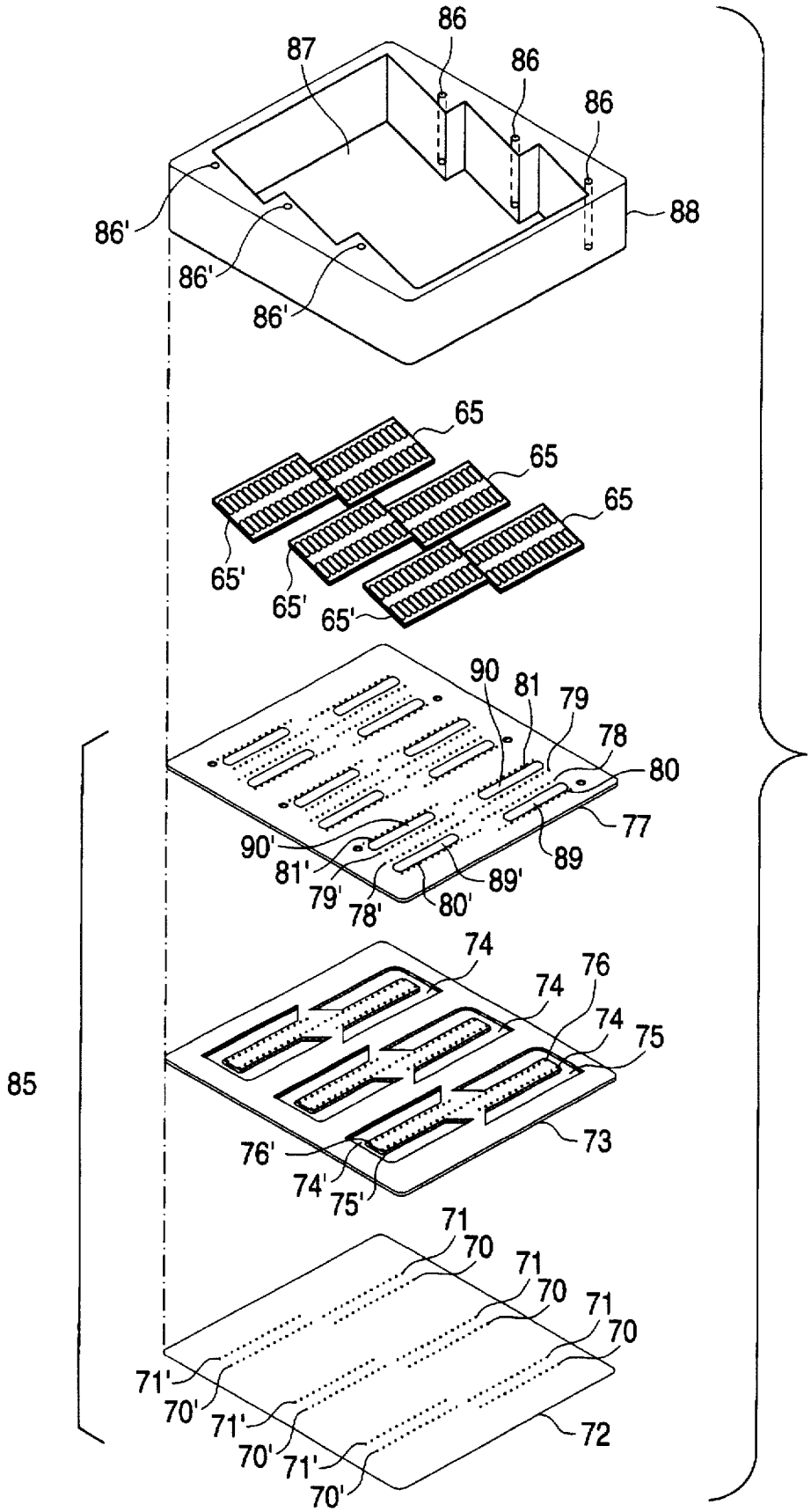
FIG. 11 is an exploded perspective view showing an example of a flow passage unit suitable for constructing a recording head having an actuator unit of the type shown in FIG. 10.

As shown in FIG. 11, a plurality of stages of nozzle opening lines, in this example, two stages of nozzle opening lines, are provided. Each stage of nozzle opening lines is composed of two lines of nozzle openings 70, 71, 70', 71' communicating with the actuator units 65, 65'. A plurality of sets of nozzle opening lines 70, 71, 70', 71', in this example, 3 sets of nozzle opening lines 70, 71, 70', 71', are provided in the paper width direction. As explained before with reference to FIG. 5, a relation between the nozzle opening lines 70, 71 and the nozzle opening lines 70', 71', arranged in the paper feed direction, is determined as follows. In the boundary region where the upper and the lower nozzle opening line oppose each other, one head unit and the other head unit are shifted relative to each other so that an interval between the lowermost nozzle opening of the nozzle opening lines 70, 71 and the uppermost nozzle opening of the nozzle opening lines 70', 71' is the same as the pitch for each set of nozzle openings. The nozzle plate 72 results.

On a reservoir-forming base board 73, cooperating with the nozzle plate 72, there are provided reservoirs 74, 74' and nozzle communicating holes 75, 76, 75', 76' for feeding ink in accordance with the actuator units 65, 65'. A cover member 77 seals the other surface of the reservoir forming base board 73, and is provided with nozzle communicating holes 78, 79, 78', 79' and ink feed ports 80, 81, 80', 81' in the same manner. When they are laminated, the flow passage unit 85 is constructed.

The actuator units 65, 65' are positioned in accordance with the nozzle communicating holes 75, 76, 75', 76' and the ink feed ports 80, 81, 80', 81' of the flow passage unit 85, and the ink feed ports 86, 86' communicating with the reservoirs 74, 74'. When the flow passage unit 85 and units 65, 65' are integrally fixed into the holder 88 by means of windows 87, the recording head is constructed. In this connection, reference numerals 89, 90, 89', 90' are recess portions formed at positions opposed to the reservoirs 74, 74', for the purpose of forming thin portions so that a compliance can be given to the reservoirs 74, 74'.

In the above example, two lines of nozzle openings are provided in the head unit. However, the present invention can be applied to a head unit in which only a single line or three or more lines of nozzle openings are provided.

In the above example, the pressure generating means includes a piezoelectric vibrator which performs deflection vibrations. However, it should be noted that the present invention is not limited to the above pressure generating means, and various other types of pressure generating means may be adopted.

Figure 12:
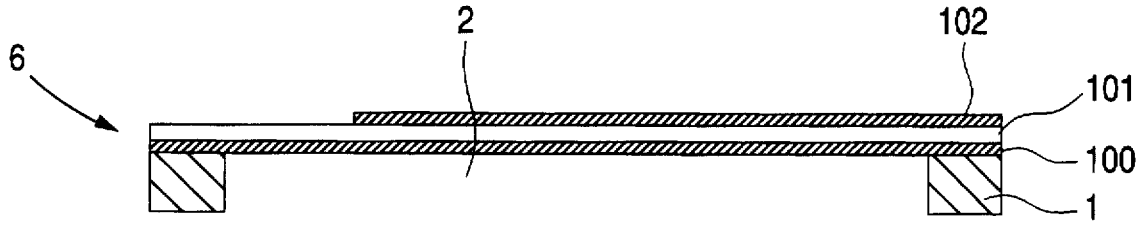
FIG. 12 shows another embodiment of a pressure generating means applicable to the present invention.

In the variant shown in FIG. 12, the diaphragm 6 for sealing the pressure generating chamber 2 is composed of a piezoelectric vibrating layer 101 formed as one piece, and the common electrode 100 is formed on the lower surface of the piezoelectric vibrating layer 101 over the entire region, or at least in regions opposing the pressure generating chamber 2. The individual electrodes 102 are respectively formed in regions opposing each pressure chamber 2 on the upper surface of the layer 101. Then, drive signals are selectively imparted to the common electrode 100 and the individual electrodes 102 on the piezoelectric layer 101 facing the various pressure generating chambers 2, to jet out ink drops by means of the resulting deflection displacement.

The above piezoelectric vibrating layer 101 can be easily made by a method appropriate for forming piezoelectric material into a sheet of film. Examples of usable methods are described below. For instance, piezoelectric material is baked to product a sheet. Alternatively piezoelectric material may be spattered onto a surface of conductive material, such as a metal sheet, to be used as a common electrode 100. According to yet another alternative, piezoelectric material may be placed onto a surface of conductive material by a hydrothermal method.

Figure 13:
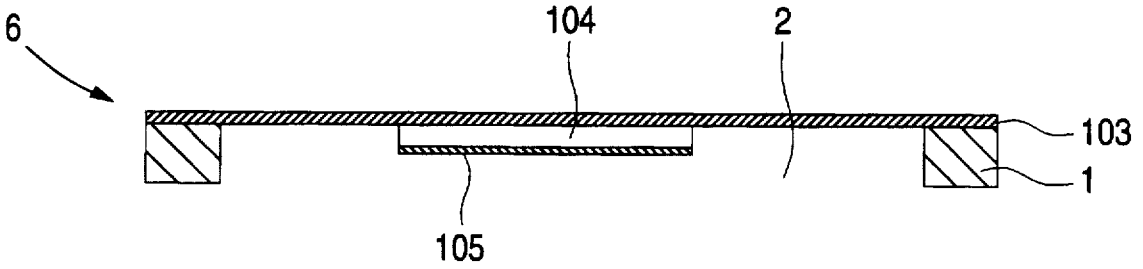
FIG. 13 is a view showing a further embodiment of the pressure generating means applicable to the present invention.

Also, it is possible to adopt the following construction. As shown in FIG. 13, the diaphragm 6 is formed as a common electrode 103 made of a metal sheet having both conductivity and elasticity. On the pressure generating chamber side 2 of this common electrode 103, a piezoelectric vibrator 104 and an individual electrode 105 corresponding to each pressure generating chamber 2 are mounted. If necessary, a sheet of material capable of being elastically deformed, for example, a sheet of zirconia may be laminated onto a surface of the common electrode 103.

Figure 14:
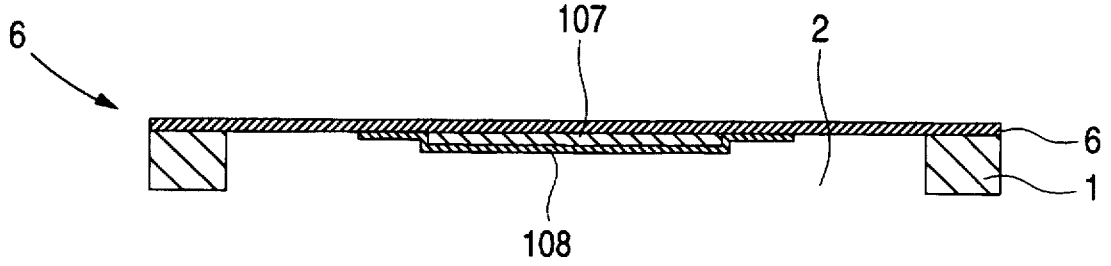
FIG. 14 shows yet another embodiment of the pressure generating means applicable to the present invention.

Yet another possible construction is illustrated in FIG. 14. As shown there, a Joule heat generating element 107 is provided on a surface of the diaphragm 6 to seal the spacer 1 on the pressure generating chamber 2 side. Alternatively, the element 107 may be provided on a surface of another member to define the pressure generating chamber 2 on the pressure generating chamber side. When necessary, an ink protective layer 108 can be formed on the Joule heat generating element 107. When the Joule heat generating element 107 is heated by application of a drive signal, the ink accommodated in the pressure generating chamber is vaporized so as to generate pressure.

Figure 15:
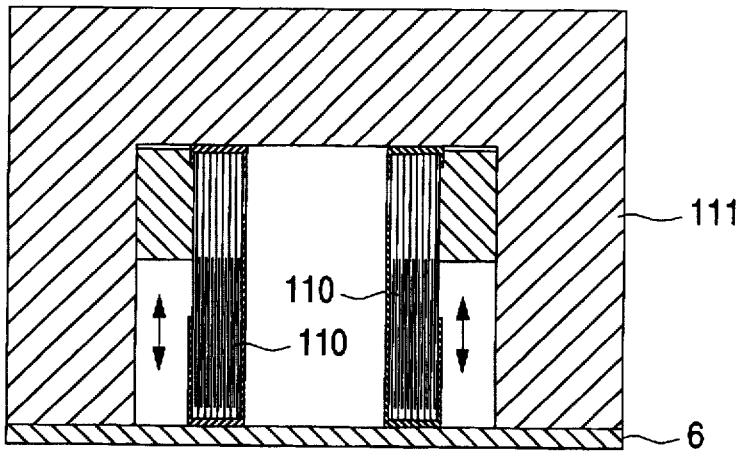
FIG. 15 is a view showing another embodiment of the pressure generating means applicable to the present invention.

Also, it is possible to adopt the following construction. As shown in FIG. 15, piezoelectric vibrators 110, 110 having a longitudinal vibration mode are fixed to the base board 111 so that front ends of piezoelectric vibrators contact the diaphragm 6. Due to the above construction, when the piezoelectric vibrators 110, 110 are linearly displaced, the pressure generating chambers 2, 3 expand and contract accordingly.

As explained above, in the present invention, a plurality of pressure generating chambers in which ink is pressurized by pressure generating means are arranged in a column. The individual pressure generating chambers are inclined at an angle θ with respect to the arrangement direction of the pressure chambers. Furthermore, an end surface of the head unit in the arrangement direction of the pressure chambers is inclined by the same angle θ with respect to the arrangement direction of the pressure chambers. To provide a recording head, a plurality of head units are fixed onto a base board in such a manner that they are shifted along the inclination. As a result, the pitch between the last pressure generating chamber on one unit and the first pressure generating chamber on the adjacent unit in the arrangement direction can be made to equal the pitch between the pressure generating chambers on the individual units. Accordingly, by moving the head unit laterally along the outer wall of the adjacent head unit, a pitch distance in the arrangement direction of the pressure generating chamber can be adjusted to achieve this equality. As a result, it is possible to arrange a plurality of head units without unduly increasing the width of the recording head.

Since the pressure generating chambers are inclined with respect to a direction perpendicular to the arrangement line of the nozzle openings, the length of the pressure generating chambers can be increased in relation to comparable pressure generating chambers that are arranged on a line perpendicular to the arrangement line of the nozzle openings. Therefore, it is possible to enhance the density of the pressure chamber arrangement without reducing the volume of individual chambers.

We claim:

1. An ink jet type recording head comprising a plurality of head units, each said head unit comprising:

a pressure generating means;

a plurality of pressure generating chambers for pressurizing ink through actuation of said pressure generating means;

a plurality of head units housing said pressure generating chambers; and a base board on which said head units are arranged; wherein:

said pressure generating chambers are arranged in line along an arrangement direction;

said pressure generating chambers are inclined at an angle θ with respect to the arrangement direction;

outer edges of said head units in the arrangement direction are inclined at the angle 0 with respect to the arrangement direction, thereby providing an inclination for each said head unit;

said head units are arranged on said base board such that each said head unit is shifted along the inclination of an adjacent one of said head units away from a position aligned with said adjacent head unit; and an amount of shift between each said head unit and said adjacent head unit is set such that a pitch between first opposing ones of said pressure generating chambers that oppose each other across said outer edges of said head unit and said adjacent head unit is equal to a pitch between second opposing ones of said pressure generating chambers that oppose each other on said head unit.

2. The ink jet type recording head according to claim 1, wherein said pressure generating means comprises a piezoelectric vibrator operating to cause a deflection vibration.

3. The ink jet type recording head according to claim 1, wherein said pressure generating means comprises a piezoelectric vibrator operating to cause a longitudinal vibration.

4. The ink jet type recording head according to claim 1, wherein said pressure generating means comprises electric resistors respectively accommodated in said pressure generating chambers.

5. The ink jet type recording head according to claim 1, wherein nozzle openings are formed on said base board.

6. The ink jet type recording head according to claim 1, wherein a hole used for positioning is formed on a center line of each said head unit located between selected ones of said pressure generating chambers.

7. The ink jet type recording head according to claim 1, wherein:

the arrangement of said head units on said base board includes a first column of said head units and a second column of said head units extending in parallel to said first column; and a first and a second column of nozzle openings, corresponding respectively to said first and second columns of head units, are formed into said base board.

8. The ink jet type recording head according to claim 1, wherein:

the amount of shift is less than a width of each said head unit, the width being measured in a direction perpendicular to the arrangement direction.

9. A recording head for an ink jet printer, comprising:

an ink flow passage unit for jetting ink from the recording head; and a plurality of actuator units for driving said ink flow passage unit to jet ink, each of said actuator units housing a plurality of pressure generating chambers and having an upper outer edge, a lower outer edge and a width, wherein:

said pressure generating chambers are arranged in at least two columns, each column being aligned in an arrangement direction;

said pressure generating chambers each have a longitudinal axis that is inclined at an angle θ with respect to the arrangement direction;

said upper and lower outer edges extend at an incline given by the angle θ with respect to the arrangement direction;

said actuator units are arranged on said ink flow passage unit such that each of said actuator units is offset along the incline from an adjacent one of said actuator units, the offset being less than the width of said actuator unit; and a pitch between a first one of said pressure generating chambers located in a first of the two columns and adjacent the lower outer edge of said actuator unit and a second one of said pressure generating chambers located in a second of the two columns and adjacent the upper outer edge of said adjacent actuator unit is substantially equal to a pitch between a third one of said pressure generating chambers located in the first of the two columns of said actuator unit and a fourth one of said pressure generating chambers located in the second of the two columns of said actuator unit.

10. The recording head according to claim 9, wherein:

the pitch between the first one of said pressure generating chambers located in the first of the two columns and adjacent the lower outer edge of said actuator unit and the second one of said pressure generating chambers located in the second of the two columns and adjacent the upper outer edge of said adjacent actuator unit is substantially equal to a pitch between a fifth one of said pressure generating chambers located in the first of the two columns of said adjacent actuator unit and a sixth one of said pressure generating chambers located in the second of the two columns of said adjacent actuator unit.

* * * * *